United States Patent [19]

Yamamoto

[11] 4,417,343

[45] Nov. 22, 1983

[54] WATER-COOLED LID MADE OF STEEL TUBING FOR ELECTRIC FURNACE

[75] Inventor: Seiji Yamamoto, Himeji, Japan

[73] Assignee: Nikko Co., Ltd., Hyogo, Japan

[21] Appl. No.: 279,083

[22] Filed: Jun. 30, 1981

[30] Foreign Application Priority Data

Oct. 1, 1980 [JP] Japan ..... 55-140711[U]
Oct. 1, 1980 [JP] Japan ..... 55-140712[U]

[51] Int. Cl.[3] ..... F27D 1/12
[52] U.S. Cl. ..... 373/73
[58] Field of Search ..... 373/73, 74, 75, 76; 432/238; 266/241

[56] References Cited

U.S. PATENT DOCUMENTS 4,216,348 8/1980 Greenberger ..... 373/74
4,273,949 6/1981 Fischer et al. ..... 373/74
4,351,055 9/1982 Bick et al. ..... 373/76

FOREIGN PATENT DOCUMENTS 54-21606 2/1972 Japan .
54-129504 9/1979 Japan .

*Primary Examiner*—Roy N. Envall, Jr.
*Attorney, Agent, or Firm*—Armstrong, Nikaido, Marmelstein & Kubovcik

[57] ABSTRACT

A water-cooled lid made of steel tubing and removably mountable on the top of the body of an electric furnace comprises a small central top portion having electrode inserting bores, a circular ring along its outer periphery and a plurality of sectorial segments arranged radially between the top portion and the circular ring. Each of the sectorial segments has a zigzag cooling water channel formed by steel tubing, extending along circumferences concentric with the lid and having a cooling water inlet and cooling water outlet. The zigzag channel is formed by bending a single steel tube into zigzag portions folded together in intimate contact with one another. Alternatively the channel is formed by a plurality of steel tubes arranged side by side in intimate contact with one another along circumferences concentric with the lid and steel frames having communicating chambers in communication with the open ends of adjoining tubes.

3 Claims, 6 Drawing Figures

WATER-COOLED LID MADE OF STEEL TUBING FOR ELECTRIC FURNACE

BACKGROUND OF THE INVENTION

The lid of a steel-making electric furnace is conventionally constructed of refractory bricks in an annular arched arrangement for removably covering the top of the furnace body.

The brick portion of the lid, which is exposed to high-temperature radiant heat within the furnace, is gradually worn away owing to the resulting thermal damage and spalling and must therefore be replaced by new bricks frequently. This leads to a reduced operation efficiency and an increased operation cost. The problem has become more serious in recent years because a greater quantity electric power is used for operation.

The above problem is attributable to the high-temperature storage of heat in the brick which is inevitable in view of the low heat transfer coefficient of the brick, so that it has been desired to reduce the area of the brick portion to the greatest possible extent. Thus, steel lids are proposed for use with electric furnaces.

Conventional steel lids for furnaces comprise divided sectorial segments each having a cooling water jacket which is made of steel plate and internally divided by partitions. Since the partitions are provided by welding, there is a limitation in reducing the width of the cooling water channel, consequently limiting the flow speed of the cooling water and the cooling efficiency.

Furthermore the welded portions of the partitions permit stagnation of the cooling water and therefore deposition of fur, resulting in increased flow resistance, an insufficient flow rate and reduced thermal conductivity. The segment is susceptible to thermal damage especially at the portions where the front panel thereof is held in contact with the partitions without being exposed to the water.

SUMMARY OF THE INVENTION

An object of the present invention is to provide a water-cooled lid for an electric furnace comprising a plurality of sectorial segments arranged radially between a small top portion and a circular ring, each of the sectorial segments being made of a single piece of steel tubing bent back upon itself to provide sections forming a zigzag cooling water channel extending along circumferences concentric with the lid, the cooling water channel being easy to form and greatly improved in its cooling efficiency and durability.

Another object of the invention is to provide a water-cooled lid of the type described in which the sectorial segment comprises a single continuous steel tube bent into a peripheral portion surrounding the periphery of a sector and a filling portion filling up the space surrounded by the peripheral portion, the filling portion including zigzag sections folded together in intimate contact with one another, the steel tube having a cooling water inlet and a cooling water outlet at its opposite ends and providing with its hollow interior a cooling water channel which does not have welded or like portions that will produce increased resistance to the flow of water or permit deposition of fur.

Another object of the invention is to provide a water-cooled lid of the type described in which the sectorial segment comprises a group of steel tubes arranged on concentric circumferences in intimate contact with one another in the form of a sector and each having open opposite ends and steel frames arranged on the opposite radial sides of the sector and joined to the open ends of the group of steel tubes, the steel frames having communicating chambers in communication with the open ends of the tubes to provide a single continuous zigzag cooling water channel by the communicating chambers and the hollow interior portions of the group of steel tubes, the channel having a cooling water inlet and a cooling water outlet at its opposite ends, whereby the lid is made easy to fabricate and greatly improved in its cooling efficiency and durability.

Still another object of the invention is to provide a water-cooled lid of the type in which the spaces between the outer peripheral portions of the steel tubing providing the zigzag cooling water channel are filled up with a hardened refractory powder at least on one side of the segment exposed to the interior of the furnace to protect the water channel from the high-temperature radient heat in the furnace and to prevent the escape of gas through the segment.

Other objects, features and advantages of the invention will become apparent from the following detailed description with reference to the accompanying drawings.

DESCRIPTION OF THE PREFERRED EMBODIMENTS

Figure 1:
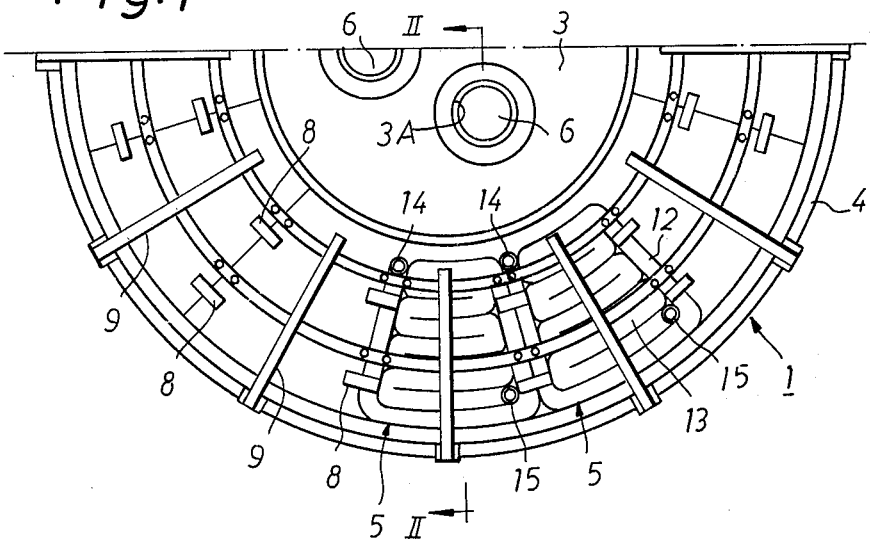
FIG. 1 is a plan view showing one half of a first embodiment of the invention.
Figure 2:
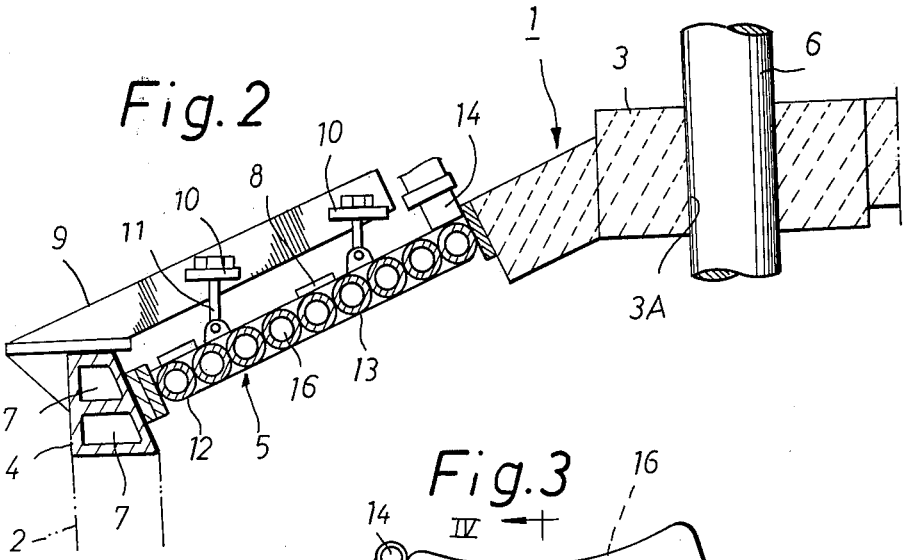
FIG. 2 is an enlarged view in section taken along the line II—II in FIG. 1.

With reference to the drawings, especially to FIG. 1, a furnace lid 1 is circular and is removably mounted on the top of the body 2 of an electric furnace shown in FIG. 2. The lid 1 has a small top portion 3 in its center and a circular steel ring 4 along its outer periphery. A plurality of sectorial segments 5 are arranged radially between the small top portion 3 and the circular ring 4.

The small top portion 3 has bores 3A for withdrawably inserting electrodes 6 therethrough and is constructed of a refractory material. As seen in FIG. 2, the circular ring 4 has a hollow circular wall having a trapezoidal cross section and having an upper and a lower independent water chamber 7.

The radially arranged sectorial segments 5 are connected to one another circumferentially of the arrangement by connectors 8, are disconnectable and are suspended from hangers 9 extending from the circular ring 4 by means of suspending members 10 and bars 11.

Figure 3:
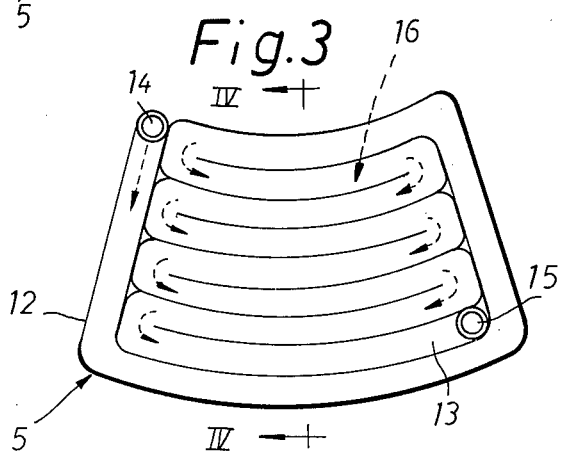
FIG. 3 is a plan view showing a sectorial segment according to the first embodiment.

As best shown in FIG. 3, the sectorial segment 5 according to a first embodiment is made by bending a single continuous drawn steel tube, such as a boiler tube, having a circular cross section. It is seen in FIG. 3 that the segment 5 has a peripheral portion 12 surrounding the periphery of a sector and a filling portion 13 filling up the space surrounded by the peripheral portion 12, the filling portion 13 including zigzag tube sections folded together in intimate contact with one another. The peripheral portion 12 has a cooling water inlet 14 at one end thereof, while the filling portion 13 has a cooling water outlet at one end thereof. Although not shown, a water supply pipe and a water discharge pipe communicating with the water chambers 7 of the circular ring 4 are connected to these inlet and outlet 14, 15 respectively.

The sectorial segment 5 is made from a single drawn tube usually by bending the tube zigzag into the filling portion 13 and further bending the tube into the peripheral portion 12 to surround the filling portion 13 with the portion 12. Thus the drawn tube forms in the segment 5 a zigzag cooling water channel 16 extending from the inlet 14 to the outlet 15.

Figure 4:
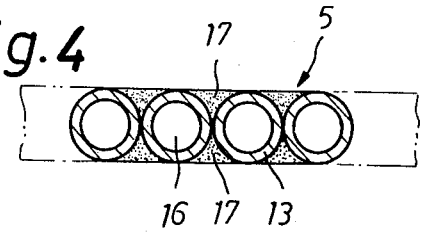
FIG. 4 is a fragmentary view in section taken along the line IV—IV in FIG. 3.

The spaces between the tube sections are filled up, for example, with a powder of refractory bricks for grouting as indicated at 17. The segment 5 is grouted as indicated at 17 in FIG. 4 on both inner and outer sides thereof but may be grouted at least on the inner side thereof, i.e. on one side to be exposed to the interior of the furnace.

Figure 5:
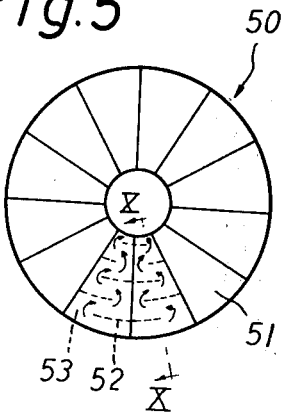
PRIOR ART Fig.5
FIG. 5 is a plan view schematically showing a conventional furnace lid.
Figure 6:
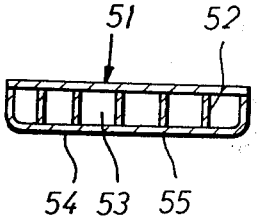
PRIOR ART Fig.6
FIG. 6 is an enlarged view in section taken along the line X—X in FIG. 9.

FIGS. 5 and 6 show a conventional furnace lid 50 of steel comprising a plurality of divided segments 51. Each of the segments 51 has a cooling water jacket which is made of steel plate and divided by partitions 52 to form a suitable cooling water channel 53. Since the partitions 52 are provided by welding, there is a limitation in reducing the width of the channel 53, consequently limiting the flow speed of the cooling water and the cooling efficiency. Furthermore the welded portions of the partitions 52 permit stagnation of the cooling water and therefore deposition of fur, resulting in increased flow resistance, an insufficient flow rate and reduced thermal conductivity. The segment 51 is susceptible to thermal damage and deformation especially at the portions 55, shown in FIG. 6, where the front panel 54 thereof is held in contact with the partitions 52 without being exposed to the water. Additionally it is impossible to give an increased cooling area to the front panel 54.

In contrast, the use of steel tubing according to the invention involves reduced flow resistance and gives an increased cooling area to the front side. The lid of the invention can be made with ease without necessitating sheet metal processing.

What is claimed is:

1. A water-cooled lid made of steel tubing for an electric furnace comprising divided sectorial segments, each of the sectorial segments having a cooling water inlet and a cooling water outlet and being formed in its interior with a zigzag cooling water channel for holding the inlet in communication with the outlet, the lid being characterized in that the cooling water channel is formed by bending a single, partition-free, steel tube of circular cross section into zigzag portions folded together in intimate contact with one another and into a peripheral portion surrounding the zigzag portions in the form of a sector in intimate contact therewith, the sectorial segment being grouted with a refractory between the adjoining outer peripheral portions of the steel tube at least on one side of the segment exposed to the interior of the furnace.

2. A lid as defined in claim 1 wherein the zigzag portions and the pheripheral portion provide channel sections which are positioned on the same plane, and the channel sections of the zigzag portions extend zigzag along circumferences concentric with the furnace.

3. A lid as defined in claim 1 or 2 wherein the sectorial segments are arranged radially between a small top portion of the lid and a circular ring having water chambers, and each two circumferentially adjacent sectorial segments are connected to each other, each of the sectorial segments being supported by suspending members attached to the circular ring.

* * * * *